US007757681B2

(12) United States Patent
Gabrel

(10) Patent No.: US 7,757,681 B2
(45) Date of Patent: Jul. 20, 2010

(54) SAFETY PAINTBALL GUN REGULATOR

(75) Inventor: Stanley Gabrel, Round Lake, IL (US)

(73) Assignee: Tippmann Sports LLC, Fort Wayne, IN (US)

( * ) Notice: Subject to any disclaimer, the term of this patent is extended or adjusted under 35 U.S.C. 154(b) by 0 days.

(21) Appl. No.: 11/124,579

(22) Filed: May 6, 2005

(65) Prior Publication Data

US 2006/0249132 A1 Nov. 9, 2006

(51) Int. Cl.
*F41B 11/00* (2006.01)

(52) U.S. Cl. ..... 124/73; 137/68.23; 137/234.5; 137/468; 137/505.42

(58) Field of Classification Search ..... 124/69–71, 124/63–65, 70–77, 45–53.5; 137/505.42, 137/505.25, 68.23, 234.5, 468; 89/193
See application file for complete search history.

(56) References Cited

U.S. PATENT DOCUMENTS 4,763,690 A * 8/1988 Martin ..... 137/613
5,127,436 A * 7/1992 Campion et al. ..... 137/614.11
5,566,713 A * 10/1996 Lhomer et al. ..... 137/613
5,996,625 A * 12/1999 Collado et al. ..... 137/614.19
6,405,722 B2 * 6/2002 Colby ..... 124/74
6,722,391 B2 * 4/2004 Gabrel ..... 137/625.69
6,899,125 B2 * 5/2005 Ellero et al. ..... 137/505.42
2003/0089402 A1 * 5/2003 Gregoire ..... 137/505.42
2006/0011183 A1 * 1/2006 Dziob ..... 124/71

* cited by examiner

*Primary Examiner*—Troy Chambers
(74) *Attorney, Agent, or Firm*—Barnes & Thornburg LLP

(57) ABSTRACT

Paintball regulators of the present invention receive higher pressure gas from a gas canister, output lower pressure gas to a gun body, but resist violent separation if inadvertently disassembled. The paintball regulators include a hollow valve body, a plug seat fixed in the valve body, a piston subassembly removably secured to the valve body, a plug, a first coacting member on the plug and a second coacting member on the piston subassembly. The valve body defines an open end for receiving the piston subassembly and a gas supply opening. A plug seat is set in the valve body such that the plug seat and the valve body together define a fluid pathway between the supply opening and the open end. The piston subassembly is removably secured to and engageable with the open end. The plug is positioned in the pathway and complementary to the plug seat. The first member, which is on the plug, and the second member, which is on the piston subassembly, coact such that the plug is offset from the plug seat when the paintball regulator is fully assembled and that the plug is received at the plug seat when the paintball regulator is less than fully assembled.

10 Claims, 3 Drawing Sheets

SAFETY PAINTBALL GUN REGULATOR

FIELD OF THE INVENTION

This invention relates to a pressure regulator suitable for use with paintball marking guns and other pressurized-gas powered devices.

BACKGROUND OF THE INVENTION

Paintball marking guns are used in a variety of targeting and simulated battle games (e.g., capture the flag). These guns launch a ball of paint with a frangible shell that is designed to hold the ball shape until striking an object after firing. Upon striking the object, the ball is set to break open leaving a paint spot.

Paintball guns typically employ a firing system powered by compressed gas such as air. Compressed air is supplied from a canister which is mounted to or carried with the gun. The gun systems also include a gun body, a paintball hopper and one or more pressure regulators which receive gas from the tank at a relatively high pressure and deliver gas at a reduced, more consistent pressure to the gun body for propelling the paintball.

The pressure regulators are modular and typically include at least two major components interconnected with threaded portions. One well-accepted type of gun system design calls for a pressure regulator to be threaded directly into the supply canister.

It is preferred, safe practice to fully discharge gas canisters before disassembling any part of the gun system. Paintball players are known to remove the regulator-canister portion of the system from the gun body without discharging the gas canister, however. Players may wish to make adjustments at remote locations or avoid the cost of a gas recharge.

Although modular paintball regulator designs are preferred for performance and maintenance, it is a concern that paintball regulator parts may be inadvertently separated when a paintball player attempts to remove a canister. If such parts are disassembled before the canister is discharged, the ultimate separation can be violent and therefore unsafe.

One approach to addressing this safety concern is the placement of special alignment markings on threaded fittings. A change in the alignment of the markings serves as a warning to the paintball player that the wrong parts are separating. Although well accepted, this approach relies on the paintball player to monitor the markings while removing the paintball regulator or canister from the gun body.

There would be several advantages to a paintball regulator system that prevents violent separation of components when inadvertently disassembled.

SUMMARY OF THE INVENTION

Paintball regulators of the present invention receive higher pressure gas from a gas canister, output lower pressure gas to a gun body, but resist violent separation if inadvertently disassembled. The paintball regulators include a hollow valve body, a plug seat fixed in the valve body, a piston subassembly removably secured to the valve body, a plug, a first coacting member on the plug and a second coacting member on the piston subassembly. The valve body defines an open end for receiving the piston subassembly and a gas supply opening. A plug seat is fixed in the valve body such that the plug seat and the valve body together define a fluid pathway between the supply opening and the open end. The piston subassembly is removably secured to and engageable with the open end. The plug is positioned in the pathway and complementary to the plug seat. The first member (on the plug) and the second member (on the piston subassembly) coact such that the plug is offset from the plug seat when the paintball regulator is fully assembled but the plug is received at the plug seat when the paintball regulator is less than fully assembled. In a preferred embodiment, the first member is a spacer integral with the plug and the second member is a land on the piston subassembly.

An embodiment of the present invention can be described as follows. The paintball regulator comprises a body and an actuator subassembly removably secured to the body. The actuator subassembly includes an actuator housing. The body has a gas source coupling portion at one end and an open opposite end. The body defines a fill port, an output port, an inlet opening in the coupling portion and an axial flow pathway in communication between the inlet opening and the open end. The coupling portion is adapted for connection to a compressed gas tank or canister. A plug is positioned in and axially movable within the pathway. A plug seat is positioned between the fluid pathway and the open end. The piston subassembly is movable between a secured assembled position in which the plug is offset from the retainer by the spacer and a secured disassembly position in which the plug is responsive to the high pressure gas to block the fluid pathway.

BRIEF DESCRIPTION OF THE DRAWINGS

In the accompanying drawings that form part of the specification like numerals are employed to designate like parts throughout the same.

DESCRIPTION OF THE PREFERRED EMBODIMENTS

Figure 1:
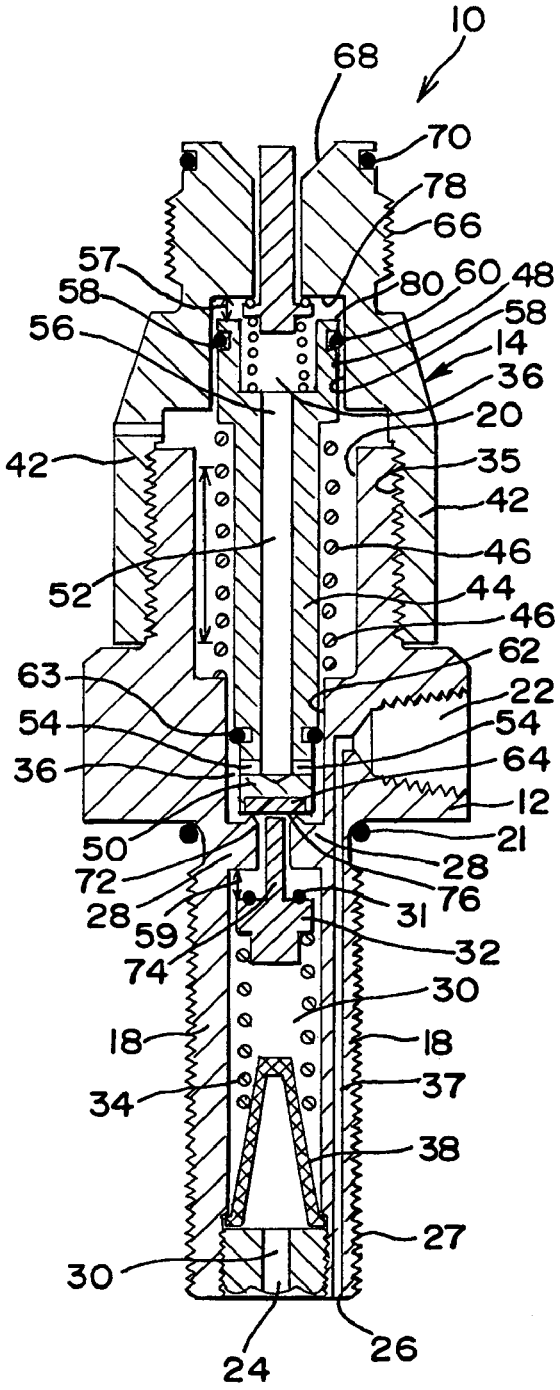
FIG. 1 is a vertical cross-sectional view of a paintball regulator according to the present invention and selected to show details of the valve body, piston subassembly, flow pathway, valve seat and plug.

Shown in the drawings and described hereinbelow in detail are preferred embodiments of the invention. The present disclosure is an exemplification of the principles of the invention and does not limit the invention to the illustrated embodiments.

Referring now to FIG. 1, paintball regulator 10 includes a substantially hollow valve body (or main component) 12 secured to a piston subassembly 14. Valve body 12 has a unitary coupling portion 18 extending away from an open end 20. Opposite coupling portion 18, valve body 12 has an open end 20. Coupling portion 18 is adapted for sealed interconnection with a compressed gas source such as a canister (not shown). The source of compressed gas is typically a canister and the outside surface of coupling portion 18 is threaded for sealed connection into a canister. In an alternate arrangement, the gas source takes the form of a fitting extending by hose from a more remote tank, in which case the coupling portion has a configuration for sealed connection to the gas supply fitting. An o-ring 21 is preferably provided on coupling extension 18 for improved seal to the gas canister.

Valve body 12 defines open end 20, a fill port 22, and a discharge opening 24 and inlet opening 26, both towards the distal end 27 of coupling portion 18. An internal plug seat 28 is positioned between discharge opening 24 and open end 20 such that valve body 12 and plug seat 28 define a fluid pathway 30. A plug 32 is disposed in pathway 30 and has a form complementary to valve seat 28. Plug 32 is preferably biased towards plug seat 28 with a spring 34 to prevent sticking. An optional o-ring 31 improves the seal between plug 32 and seat 28.

Piston subassembly 14 and open end 20 of body 12 are removably secured together with complementary threaded sidewalls. More specifically, valve body 12 has outer threads 33 and the piston housing 14 has corresponding inwardly-facing threads 35.

Pathway 30 delivers compressed gas from the source into chamber 36. A second fluid pathway 37 is defined between fill port 22 and inlet opening 26 to provide a path for compressed gas to enter a gas source. Pathway 30 is preferably equipped with a contoured mesh filter 38. Filter 38 prevents particles and other gas impurities from entering and fouling the paintball regulator valve mechanisms. A suitable sintered brass filter of 40 microns is commercially available from Capstan Permaflow (Gardena, Calif.). Filter 38 is secured within body 12 with hollow retainer 40 secured to coupling portion 18 (preferably with complementary threads).

Piston subassembly 14 includes a piston housing 42, a piston 44 and a main piston spring 46. Piston 44 has a barrier portion 48 and a stopper portion 50. Piston 44 defines an internal gas flow passageway 52 extending from radial inlets 54 in stopper portion 50 to a central opening 56 in barrier portion 48. Barrier portion 48 forms a seal with inner side walls 58 of housing 42 via an o-ring 60. Likewise, stopper portion 50 of piston 44 forms a seal with inner side walls 62 of body 12 via an o-ring 63. Stopper portion 50 preferably includes an insert 64 of resilient material.

The gas source canister is filled through paintball regulator 10 with a supply hose (not shown) temporarily connected into fill port 22. Compressed gas enters fill port 22 and moves through second confined-flow pathway 37 to inlet opening 26 and then into supply tank (not shown). In this way, the flow of compressed gas for refill does not enter pathway 30 or impact other parts (e.g., plug 32) of the regulator piston mechanism. Paintball regulator 10 is illustrated without an adapter in fill port 22 to better reveal internal details. Fill port 22 is preferably equipped with an internal seal holder (e.g., a check valve) to seal pressurized gas into the canister.

Although other configurations are contemplated, paintball regulator 10 is adapted for use as a "screw-in" type paintball regulator. Therefore, piston housing 42 of subassembly 14 has a threaded portion 66 opposite coupling portion 18. Portion 18 is sized and threaded to be received into a corresponding socket on a paintball gun system. An axial outlet port 68 in housing 42 delivers regulated gas to the paintball gun. An o-ring seal 70 is provided in a groove offset from the end of housing 42.

In operation, threaded portion 66 is received in a paintball gun assembly and a charged gas cannister is connected to threaded coupling portion 18. Compressed gas flows from the gas canister into discharge opening 24 and then into pathway 30 as it passes through filter retainer 30 and filter 38. When body 12 and piston subassembly 14 are fully assembled as shown in FIG. 1, plug 32 is offset from seat 28 such that gas flows around plug 32 and into orifice 72 of seat 28.

Paintball regulator 10 is shown with piston 44 in the closed condition when the outlet side pressure at port 68 is at the required pressure. In the closed condition, the controlled-pressure gas indicated generally at 36 creates a force on the piston 44 in the direction of seat 28 that is sufficient to counter the opposing force generated by spring 46 and compressed gas in pathway 30. This in turn urges stopper 64 against seat 28 to block flow through paintball regulator 10.

When gas pressure on the outlet side drops because, for example, a paintball is fired, the opposing forces balancing on piston 44 are disrupted as follows. The gas-pressure force on piston 44 in the direction of seat 28 momentarily drops allowing the force of spring 46 and gas pressure at 30 to open a gap between stopper 48 and orifice 72. With a gap momentarily present between seat 28 and stopper 64, gas flows from the gas canister in discharge opening 24 into pathway 30 through filter retainer 40 and filter 38, around plug 32, through orifice 72 of seat 28, into chamber 36, through radial inlets 54 and internal passage 52 and finally out to the paintball gun through outlet 68. When gas pressure at 68 again increases, piston 44 returns to the closed condition, i.e., the gap between stopper 64 and seat 28 is again closed.

As noted above, in normal operation, gas flows through pathway 30 because plug 32 is offset from seat 28. When body 12 and piston subassembly 14 are fully assembled as shown in FIG. 1, spacer member 74 on plug 32 coacts with land member 76 on piston 44 to keep plug 32 offset from seat 28 such that gas flows around plug 32 and into orifice 72 of seat 28.

Figure 2:
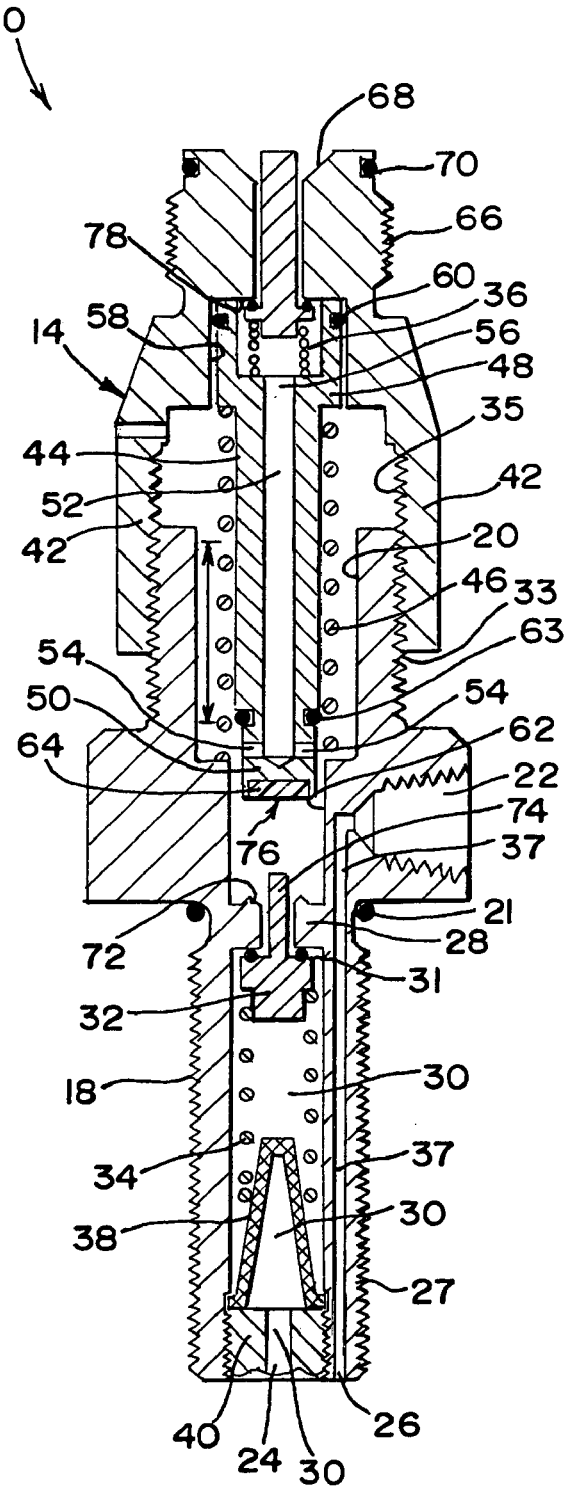
FIG. 2 is a vertical cross-sectional of the paintball regulator in FIG. 1 shown in a partially disassembled, but secure position.

A key feature of the present invention is the coaction between first member 74 and second member 76. When body 12 and piston subassembly 14 are less than fully assembled together, land 76 is positioned relatively further from seat 28 such that plug 32 can be received by plug seat 28. If the main paintball regulator components (12 and 14) are partially "unscrewed,"—i.e. counter-rotated—when the paintball gun system is charged with compressed gas, paintball regulator 10 moves to a safety position in which gas through pathway 30 is blocked by a plug 32. This less than fully assembled configuration is shown in FIG. 2.

It is a significant feature of paintball regulators according to the present invention that pathway 30 becomes blocked during disassembly while the main components (e.g., body 12 and piston subassembly 14) are still mechanically secured together. This feature prevents violent separation of paintball regulator components during disassembly even if an operator inadvertently fails to discharge the gas tank. Regulator 10 specifically demonstrates this feature via the dimensional relationship that the secured engagement range for main components 12 and 14 is greater than the offset plug 32 and seat 28 as measured when piston 44 is in a closed condition and paintball regulator 10 is fully assembled. As used herein, "secured engagement range" is a reference to the length over which major components (e.g., 12 and 14) are secured together during assembly and disassembly, a measure of the distance between first engagement and full assembly.

It is also preferred feature of the present invention that the range of axial motion 57 of piston 44 is less than the offset between plug 32 and seat 28 as measured when piston 44 is in a closed condition and paintball regulator 10 is fully assembled. For paintball regulator 10, the range of axial motion is identified with reference number 57, which reflects the gap between surface 78 of housing 42 and an end surface 80 of piston 44. The offset between plug 32 and seat 28 when piston 44 is in a closed condition is indicated by reference number 59. It is preferred that range of motion 57 be a distance less than the length of gap 59 for more reliable operation of paintball regulators according to the present invention.

Figure 3:
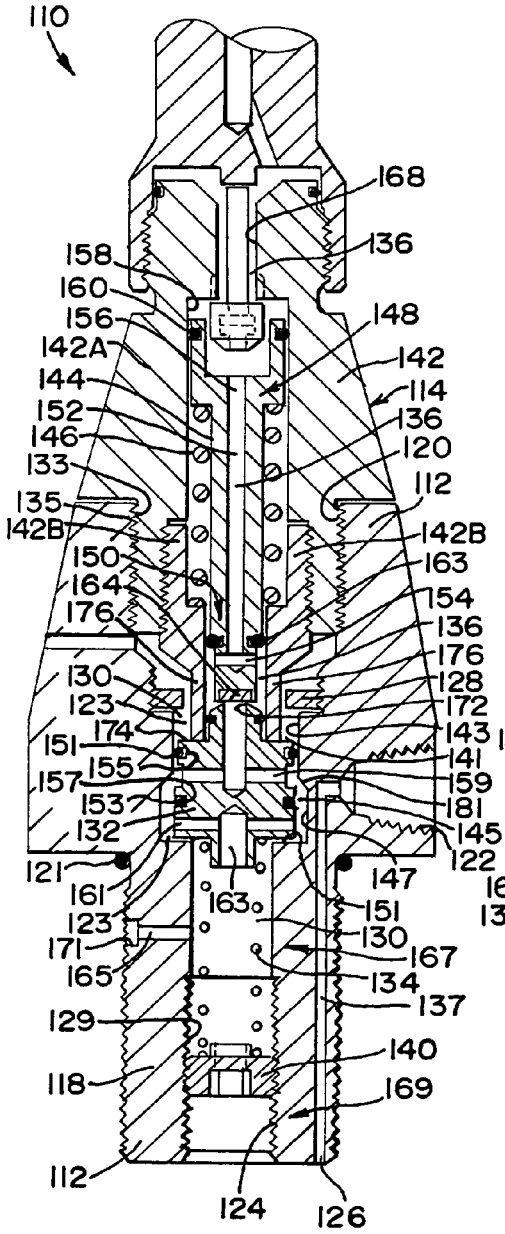
FIG. 3 is a vertical cross-sectional view of paintball regulator according to an alternate embodiment shown in an assembled position.
Figure 4:
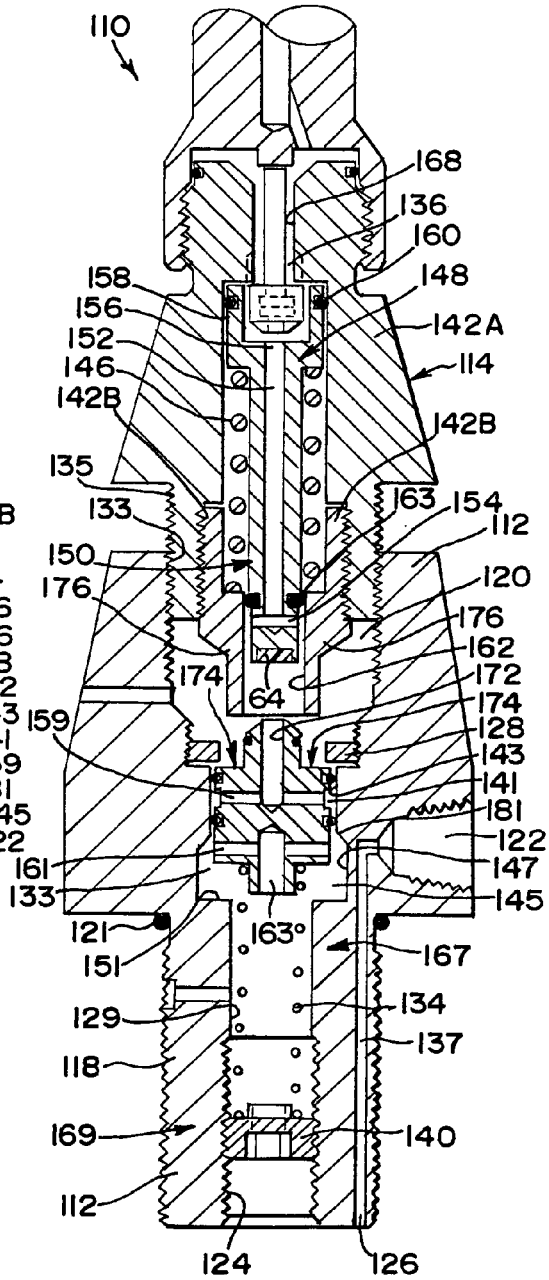
FIG. 4 is a vertical cross-sectional of the paintball regulator in FIG. 3 shown in a less than fully assembled, but secure position.

Another paintball regulator according to the present invention is shown in FIGS. 3 and 4. Paintball regulator 110 includes two major components: a hollow body 112 and a piston subassembly 114. Body 112 includes an open end 120, a discharge opening 124 and an axial bore 129 extending between discharge opening 124 and open end 120. A retainer 128 is fixed within body 112 and positioned between bore 129 and open end 120. Valve body 112 and retainer 128 together define in part a gas pathway 130.

Opposite open end 120, valve body 112 defines a unitary threaded coupling portion 118 through which bore 129 extends. Coupling portion 118 is adapted for sealed interconnection with a compressed gas canister. An o-ring 121 provides improved sealing for the connection to a gas canister.

Piston subassembly 114 is removably secured to open end 120 of body 112 with complementary threaded sidewalls: inwardly facing threads 133 on valve body 112 and outwardly facing threads 135 on piston housing 114. Subassembly 114 includes a housing of two parts 142A and 142B, a piston 144 and a main piston spring 146. Piston 144 defines an internal gas flow passageway 152 extending from radial inlets 154 in a stopper portion 150 to a central opening 156 in a barrier portion 148. Barrier portion 148 forms a seal with inner side walls 158 of housing 142 via an o-ring 160. Stopper portion 150 preferably includes a disk 164 of resilient material. Stopper portion 150 forms a seal with inner side walls 162 of housing 142B via an o-ring 163

Piston resilient disk 164 seals over an orifice 172 defined by an insert 132 that is disposed in an insert chamber 123 of pathway 130. Insert chamber 123 is sized to receive insert 132 in a sealed arrangement. Insert chamber 123 includes a relatively narrow zone 141 surrounded by sidewalls 143, a relatively wider zone 145 surrounded by sidewalls 147, and a stop surface 151. Insert 132 has a spool-like configuration with o-rings 151 and 153 and respective recesses 155 and 157. Insert 132 further includes internal passages. These are piston-side internal passages 159 which communicates with orifice 172, and tank-side internal passages 161 which communicates with bore 129. Insert 132 has an additional o-ring 173 for sealing with sidewalls 162 of piston housing 142.

Paintball regulator 110 further includes a spring 134 for biasing insert 132 towards retainer 128 and a corresponding spring retainer 140 secured within bore 129 (and pathway 130) by complementary threading.

When piston subassembly 114 is fully assembled to body 112, insert 132 serves as confined flow guide directing the flow of gas through pathway 130. Paintball regulator 110 is shown in FIG. 3 with piston 144 in the closed regulator condition when the outlet side pressure at port 168 is at the required regulated pressure. In the closed condition, the controlled-pressure gas indicated generally at 136 creates a force on the piston 144 in the direction of insert 132 that is sufficient to counter the opposing force generated by spring 146 and compressed gas in pathway 130. This in turn urges stopper 164 against orifice 172 to block flow through paintball regulator 110.

When gas pressure on the outlet side drops because, for example, a paintball is fired, the opposing forces balancing on piston 144 are disrupted as follows. The gas-pressure force on piston 144 in the direction of insert 132 momentarily drops allowing the force of spring 146 and gas pressure at 130 to open a gap between stopper 148 and orifice 172. With a gap momentarily present between orifice 128 and disk 164, gas flows in the following general sequence: from the canister gas source into body 112 at discharge opening 124, through spring retainer 140, into opening 163 and through passages 161 of insert 132, into insert chamber 145, returning into insert 132 at passages 159, through orifice 128, into chamber 136, through radial inlets 154 and internal passage 152 and finally out to the paintball gun through outlet 168. When gas pressure at 168 again increases, piston 144 returns to the closed condition, i.e., the gap between stopper 164 and orifice 128.

The action and function of insert 132 within chamber 123 is a key feature of the present invention. A related key feature of the embodiment shown in FIGS. 3 and 4 is the coaction between first member 174 and second member 176. When piston subassembly 114 is fully assembled to body 112 as shown in FIG. 3, insert 132 serves as confined flow guide directing the flow of gas through the tank-side of paintball regulator 110. In this assembled configuration, one side of insert 132 seals with walls 143 (preferably via o-ring 151). Compressed gas in pathway 130 is thereby directed into passages 161 and 159 of insert 132. As noted above, when body 112 and piston subassembly 114 are fully assembled as shown in FIG. 3, spacer member 176 on piston subassembly 114 coacts with land member 174 on spacer 132 to keep spacer 132 offset from retainer 128 such that gas flows through and around insert 132 and then into orifice 172.

When body 112 and piston subassembly 114 are less than fully assembled, however, insert 132 moves past funnel shaped portion 181 of chamber 123 and towards retainer 164. This less than fully assembled position is shown in FIG. 4. Insert 132 is adjacent retainer 164 and the tank-side of insert 132 seals with sidewalls 141 with the aid of o-ring 153 to block gas flow out of body 112.

When body 112 and piston subassembly 114 are less than fully assembled together, the spacer/extension portion 176 of piston subassembly 114 is withdrawn from (or through) retainer 128 such that insert 132 moves to a plugged-flow position next to retainer 128. If the main paintball regulator components (112 and 114) are even partially "unscrewed" when the paintball gun system is charged with compressed gas, paintball regulator 110 will move to a safety position in which gas through pathway 130 is blocked by insert 132, preferably at o-rings 153. Pathway 130 becomes blocked during disassembly while the main components (e.g., body 112 and piston subassembly 114) are still mechanically secured together. This feature prevents violent separation of paintball regulator components during disassembly even if an operator inadvertently fails to discharge the gas tank.

Another safety feature of paintball regulator 110 is a vent 165 to pathway 130 provided in the proximal portion 167 of coupling 118. Coupling 118 has a proximal, gun-side portion 167 and a distal portion 169. When coupling portion 118 is fully rotated into the socket of a tank or canister, vent 165 is closed, i.e., plugged by the tank. When paintball regulator 110 is disassembled, i.e., unthreaded from a tank, vent 165 will be unsealed as coupling 118 moves out from the tank. Because vent 165 is defined in the proximal portion 167 of coupling 118, vent 165 will become open to atmosphere before paintball regulator 110 is fully disassembled. Distal portion 169 of coupling 118 remains secured to the tank after vent 165 is open. This feature is advantageous because, if a gun user inadvertently begins to remove regulator 110 from a tank without discharging the tank, the compressed gas contents of the tank will escape through vent 165 and prevent any violent separation which can occur when parts are separated under pressure.

A problem or disadvantage with safety vents in threaded tank couplings is plugging with the glue or other adhesive, which is used to secure threaded tank connections. Vent 165 of paintball regulator 110 has a counterbore 171 to better prevent such glue plugging.

Paintball regulator 110 also includes a separate gas source filling circuit. Body 112 defines a fill port 122, a second confined-flow pathway 137 and an inlet opening 126 in coupling portion 118. Inlet opening 126 communicates with the gas source tank or canister (not shown). Flow of compressed gas for refill does not enter pathway 130 or impact other parts (e.g., insert 132) of the regulator mechanism. Paintball regulators 10 and 110 are illustrated without conventional adapters threaded into fill ports 22 and 122 to better show internal details. In use, fill ports 22 and 122 are equipped with an internal seal holder (e.g., a check valve) to seal pressurized gas into the canister.

Figure 5:
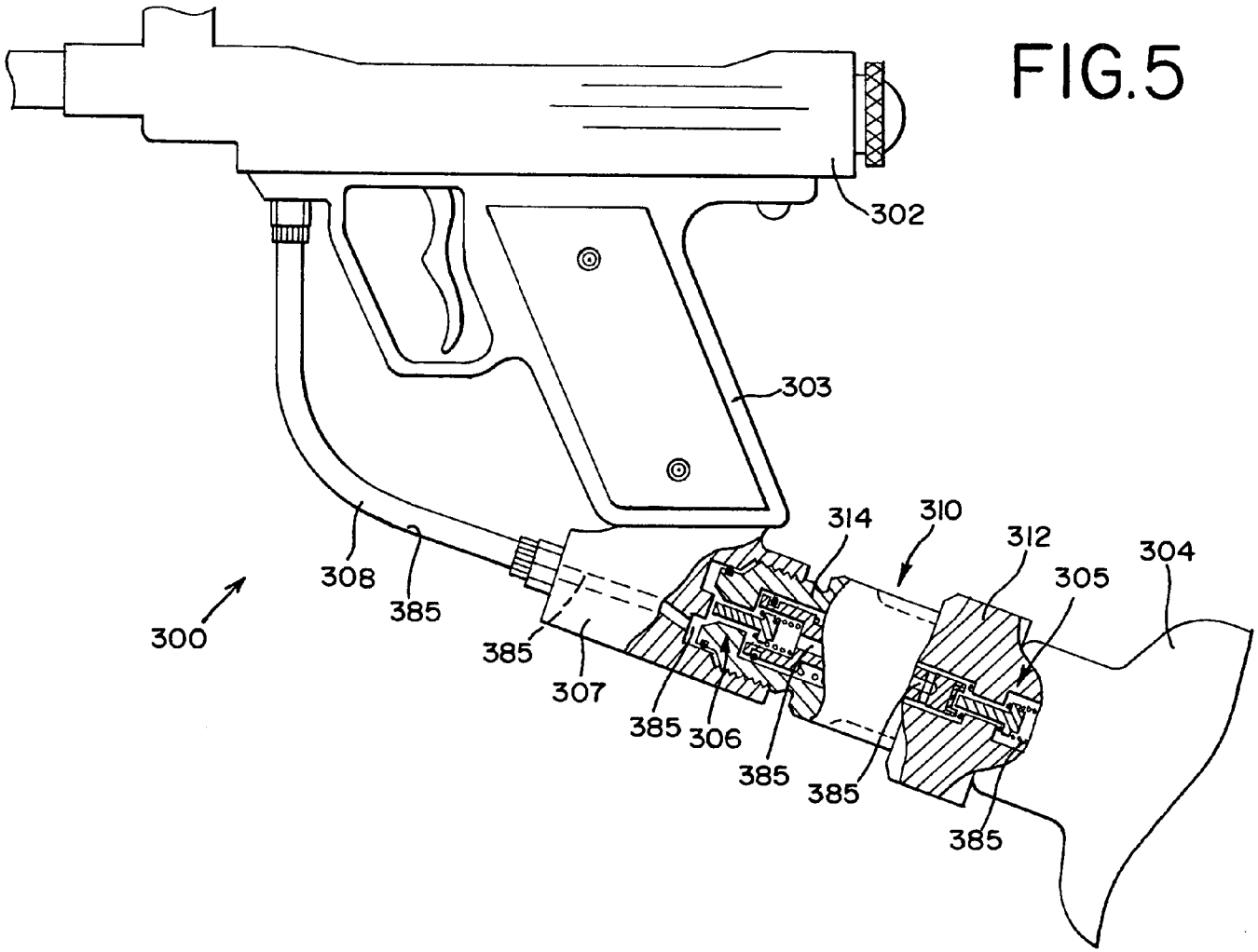
FIG. 5 is a side elevation view of a paintball gun system partly in section to reveal internal details.

FIG. 5 shows a gun system aspect of the present invention. Gun system 300 includes a gun body 302, grip frame 303, a pressurized gas canister (or tank) 304, a first fluid pathway segment 312, a second fluid pathway segment 314, an adapter 307 and a hose 308. Segments 312 and 314 together define in part a fluid pathway 385 between tank 304 and gun body 302.

In the gun system embodiment shown in FIG. 6, first segment 312 is a regulator body portion and second segment 314 is a piston subassembly. Accordingly, first segments 312 and second segment 314 when assembled together define a paintball regulator 310.

Segment 312 includes a first safety valve 305 operably associated with fluid pathway 385 such that pathway 385 becomes blocked if segment 312 is partially disconnected or disassembled from segment 314. Safety valve 305 is maintained in the open state when segments 312 and 314 are fully assembled together. Segment 314 includes a second safety valve 306 operably associated with fluid pathway 385 such that pathway 385 becomes blocked if segment 314 is partially disconnected or disassembled from adapter 307.

A wide variety of conventional materials are suitable for making the components of regulators embodying the present invention. These materials include metals, notably steels, and various high-strength composites without limitation that all or any of the elements be made of the same material. Regulator body (12, 112) and actuator housing (42, 142A, 142B) can be manufactured from a wide variety of materials having the requisite strength, rigidity and corrosion resistance. Aluminum and steel are suitable. Particularly preferred materials of construction are aluminum alloy 6061-T6, 302-304 stainless steel and 316 stainless steel.

The material of construction for stoppers 64, 164 is preferably relatively rigid but softer than the material of construction of seat 28 and insert 132. Stoppers 64, 164 are preferably made from a polymeric material. Presently preferred polymeric materials for stoppers are the fluoropolymer compounds such as polytetrafluoroethylene (PTFE), fluorinated ethylene-propylene (FEP), perfluoroalkoxy fluorocarbon resin (PFA), polychlorotrifluoroethylene (PCTFE), ethylene-chlorotrifluoroethylene copolymer (ECTFE), ethylene-tetrafluoroethylene copolymer (ETFE), polyvinylidene fluoride (PVDF), polyvinyl fluoride (PVF). Most preferred is a polychlorotrifloroethylene (PCTFE) commercially available from 3M Company under the designation "Kel-F."

An alternate embodiment of the invention and a variation of the paintball gun regulator shown in FIGS. 1 and 2 is a paintball gun regulator having a plug 32 comprising a polymeric material. Presently preferred polymeric materials for plug 32 are the fluoropolymer compounds such as polytetrafluoroethylene (PTFE), fluorinated ethylene-propylene (FEP), perfluoroalkoxy fluorocarbon resin (PFA), polychlorotrifluoroethylene (PCTFE), ethylene-chlorotrifluoroethylene copolymer (ECTFE), ethylene-tetrafluoroethylene copolymer (ETFE), polyvinylidene fluoride (PVDF), polyvinyl fluoride (PVF). Most preferred is a polychlorotrifloroethylene (PCTFE) commercially available from 3M Company under the designation "Kel-F."

A variation of the paintball gun regulator shown in FIGS. 1 through 4 calls for piston stopper portions 50, 150 to be relatively harder than a relatively softer, polymeric plug seat 28 or retainer 128.

The foregoing specification and drawings are to be taken as illustrative but not limiting of the present invention. Still other configurations and embodiments utilizing the spirit and scope of the present invention are possible.

I claim:

1. A paintball gun regulator for receiving high pressure gas from a gas canister and outputting lower pressure gas to a paintball gun body, the regulator comprising:

a hollow valve body defining an open end and a supply opening;

a plug seat fixed in the valve body, the plug seat and the valve body together defining a fluid pathway between the supply opening and the open end;

a piston subassembly removably secured to the open end over a secured engagement range;

a plug in the pathway and complementary to the plug seat;

a first coacting member on the plug and a second coacting member on the piston subassembly, wherein the members coacting such that the plug is offset from the plug seat to allow flow through the fluid pathway between the supply opening and the open end when the piston subassembly is fully assembled with respect to the valve body and the plug is received at the plug seat to block flow through the fluid pathway between the supply opening and the open end when the piston subassembly is less than fully assembled with respect to the valve body and wherein said secured engagement range is greater than said offset.

2. The regulator according to claim 1 wherein the member on the plug is a spacer integral therewith and the member on the piston subassembly is a land.

3. The regulator according to claim 1 wherein the piston subassembly includes a piston housing, the member on the piston subassembly is a spacer extending from the piston housing, and the member on the plug is a land for engaging the spacer.

4. The regulator according to claim 1 wherein the plug seat is defined by and unitary with the valve body.

5. The regulator according to claim 1 wherein the plug seat is a narrowing of the fluid pathway.

6. The regulator according to claim 1 wherein the plug seat defines an opening between the fluid pathway and the open end.

7. The regulator according to claim 6 wherein one of the members extends through the opening when the regulator is fully assembled.

8. The regulator according to claim 1 wherein the piston subassembly and the open end are removably secured by complementary threaded portions.

9. The regulator according to claim 1 wherein the valve body further defines a fill port, an inlet opening and a second fluid pathway between the fill port and the inlet opening.

10. A paintball gun regulator for receiving high pressure gas from a gas canister and outputting lower pressure gas to a paintball gun body, the regulator comprising:

a gas canister defining an internal cavity with a high pressure gas;

a paintball gun including an inlet port configured to receive a pressurized gas;

a regulator defining a fluid pathway between the gas canister and the inlet port, wherein the regulator is configured to regulate the high pressure gas received from the canister to a lower pressure gas that is outputted to the inlet port;

wherein the regulator includes a body comprising a first component that is coupled with a second component;

wherein the regulator includes a plug that is movable between a closed position that is configured to block flow through the fluid pathway and an open position that allows flow through the fluid pathway;

wherein the plug moves to the closed position in response to the first component being less than fully assembled with respect to the second component; and wherein the plug moves to the open position in response to the first component being fully assembled with respect to the second component.

* * * * *